US010407961B2

(12) United States Patent
Fox

(10) Patent No.: US 10,407,961 B2
(45) Date of Patent: Sep. 10, 2019

(54) DOOR CLOSURE ASSEMBLY

(71) Applicant: Art Design Works LLC, Lexington, MA (US)

(72) Inventor: Henry Fox, Newburyport, MA (US)

(73) Assignee: Art Design Works LLC, Lexington, MA (US)

( * ) Notice: Subject to any disclaimer, the term of this patent is extended or adjusted under 35 U.S.C. 154(b) by 0 days.

(21) Appl. No.: 15/493,907

(22) Filed: Apr. 21, 2017

(65) Prior Publication Data

US 2018/0305964 A1 Oct. 25, 2018

(51) Int. Cl.

| | |
|---|---|
| ***E05D 15/34*** | (2006.01) |
| ***E05D 15/28*** | (2006.01) |
| ***E05F 5/06*** | (2006.01) |
| ***E05D 15/32*** | (2006.01) |
| ***E06B 3/46*** | (2006.01) |

(52) U.S. Cl.

CPC ..... *E05D 15/34* (2013.01); *E05D 15/28* (2013.01); *E05D 15/32* (2013.01); *E05F 5/06* (2013.01); *E06B 3/4672* (2013.01); *E05Y 2201/224* (2013.01); *E05Y 2201/62* (2013.01); *E05Y 2201/686* (2013.01); *E05Y 2600/41* (2013.01); *E05Y 2900/20* (2013.01)

(58) Field of Classification Search

CPC ..... E05D 15/28; E05D 15/32; E05D 15/34; E05F 5/06; E06B 3/367

USPC .... 312/322, 323, 325, 138.1, 139.1; 49/125, 49/127, 128, 130

See application file for complete search history.

(56) References Cited

U.S. PATENT DOCUMENTS

| | | | |
|---|---|---|---|
| 1,197,031 | A | 9/1916 | Kelly |
| 2,228,711 | A | 1/1941 | Steuber |
| 2,361,403 | A | 10/1944 | Kabot |
| 2,573,236 | A | 10/1951 | Whittit |
| 2,780,458 | A | 2/1957 | Thaxton |
| 2,828,505 | A | 4/1958 | Hutzelman |
| D191,273 | S | 9/1961 | Knoll |
| 3,121,251 | A | 2/1964 | Hogedal |
| D202,259 | S | 9/1965 | Kendrick |
| D221,160 | S | 7/1971 | Ungaro |

(Continued)

FOREIGN PATENT DOCUMENTS

| | | |
|---|---|---|
| EP | 1502536 B1 | 9/2005 |
| EP | 2873581 A1 | 5/2015 |

(Continued)

OTHER PUBLICATIONS

Door Geometries. Figure. Publicly available prior to Apr. 21, 2017. 1pg.

(Continued)

*Primary Examiner* — James O Hansen

(74) *Attorney, Agent, or Firm* — Wolf, Greenfield & Sacks, P.C.

(57) ABSTRACT

A door closure assembly and a method of moving a door is disclosed. The door closure assembly includes a cabinet attachment member attachable to a cabinet, a door attachment member attachable to a door, and first and second arms hingedly attached to the cabinet attachment member and the door attachment member. In some embodiments, the cabinet attachment member is attached to a central portion of the door and the door attachment member is attached to an end portion of the door.

22 Claims, 13 Drawing Sheets

(56) References Cited

U.S. PATENT DOCUMENTS

| | | | | |
|---|---|---|---|---|
| 3,748,009 | A | 7/1973 | Stone | |
| 3,906,668 | A | 9/1975 | Simmons | |
| D245,655 | S | 9/1977 | Friedrich | |
| 4,090,755 | A | 5/1978 | Johnson | |
| 4,208,850 | A | 6/1980 | Collier | |
| 4,268,996 | A * | 5/1981 | Allen | B60J 5/06 49/212 |
| 4,364,201 | A | 12/1982 | Taylor | |
| 4,454,685 | A | 6/1984 | van der Sloot et al. | |
| 4,495,729 | A | 1/1985 | Britzke et al. | |
| 4,571,776 | A | 2/1986 | Taylor | |
| 4,689,852 | A | 9/1987 | Buckley | |
| 4,756,054 | A * | 7/1988 | Mitts | E05D 15/46 16/237 |
| D303,465 | S | 9/1989 | Stanek et al. | |
| 5,244,265 | A | 9/1993 | Chiang | |
| D371,734 | S | 7/1996 | Akers | |
| 5,826,923 | A | 10/1998 | Bethurem | |
| 5,898,977 | A | 5/1999 | Muir | |
| 5,921,613 | A | 7/1999 | Breunig et al. | |
| 6,030,025 | A * | 2/2000 | Kanerva | B60J 5/047 296/146.12 |
| 6,758,539 | B2 * | 7/2004 | Cianetti | A47F 3/007 312/137 |
| D516,224 | S | 2/2006 | Brandon | |
| 7,780,249 | B2 * | 8/2010 | Cianetti | A47F 3/007 312/137 |
| D632,946 | S | 2/2011 | Hartgens | |
| D635,435 | S | 4/2011 | Yamaguchi | |
| D638,686 | S | 5/2011 | Gordon | |
| 7,946,665 | B2 * | 5/2011 | Backhaus | E05D 15/264 312/324 |
| D669,600 | S | 10/2012 | Thielke et al. | |
| 8,572,811 | B2 * | 11/2013 | Lautenschlager | E05D 3/14 16/286 |
| D789,176 | S | 6/2017 | Bruce | |
| D818,346 | S | 5/2018 | Fox | |
| 2001/0039762 | A1 * | 11/2001 | Giovannetti | E05F 1/1091 49/246 |
| 2003/0204999 | A1 | 11/2003 | George et al. | |
| 2006/0043850 | A1 * | 3/2006 | Rapier, III | E05D 3/14 312/321.5 |
| 2014/0192504 | A1 | 7/2014 | Richard et al. | |
| 2015/0241113 | A1 * | 8/2015 | Kim | E05D 7/00 312/405 |
| 2016/0000236 | A1 * | 1/2016 | Goppion | E05D 15/46 312/138.1 |

FOREIGN PATENT DOCUMENTS

| | | | |
|---|---|---|---|
| GB | 452679 | A | 8/1936 |
| GB | 781969 | A | 8/1957 |
| GB | 898134 | A | 6/1962 |
| GB | 1114981 | A | 5/1968 |
| GB | 1228969 | A | 4/1971 |
| JP | 8-121012 | A | 5/1996 |
| KR | 300693614.0000 | | 5/2013 |

OTHER PUBLICATIONS

U.S. Appl. No. 29/598,923, filed Mar. 29, 2017, Fox.
U.S. Appl. No. 29/598,924, filed Mar. 29, 2017, Fox.

* cited by examiner

DOOR CLOSURE ASSEMBLY

FIELD

The disclosed embodiments relate generally to door closure assemblies, and more particularly to arrangements suitable for opening and closing cabinet doors.

BACKGROUND

Door closure assemblies are used to facilitate opening and closing doors. Such assemblies are used in homes, offices, warehouses and elsewhere to open and close doors. For example, door closure assemblies may be used to open and close cabinet doors. Various types of door closure assemblies are known, such as hinges that allow the door to pivot open and closed, or rails that allow a door to slide open and closed.

SUMMARY

According to one embodiment, a door closure assembly includes a first attachment member attachable to a central portion of a cabinet, a second attachment member attachable to an end portion of a door, a first arm having first and second ends, the first end of the first arm being pivotally connected to the first attachment member, and the second end of the first arm being pivotally connected to the second attachment member, and a second arm having first and second ends, the first end of the second arm being pivotally connected to the first attachment member, and the second end of the second arm being pivotally connected to the second attachment member.

According to another embodiment, a combination includes a cabinet having a frame and a door, a first arm having first and second ends, the first end of the first arm being pivotally connected to a central portion of the cabinet frame and the second end of the first arm being pivotally connected to an end portion of the door, and a second arm having first and second ends, the first end of the second arm being pivotally connected to the central portion of the cabinet frame and spaced from the first end of the first arm, the second end of the second arm being pivotally connected to the end portion of the door and spaced from the second end of the first arm.

According to still another embodiment, a method of moving a cabinet door is disclosed. The cabinet door is attachable to a cabinet via a door closure assembly having a first attachment member attachable to a central portion of a cabinet, a second attachment member attachable to an end portion of the door, and first and second arms pivotally attached to each of the first and second attachment members. The method includes moving the door outwardly and away from a cabinet, and pivoting the first and second arms relative to the first and second attachment members.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
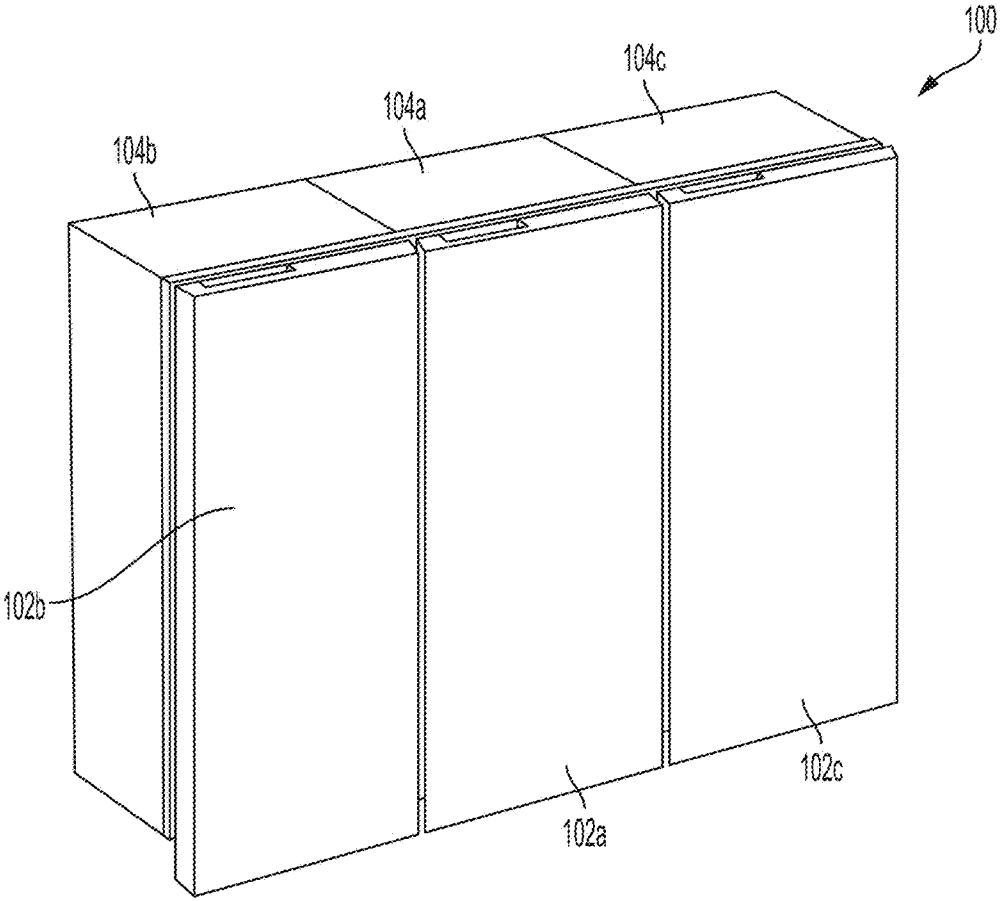
FIG. 1 is a perspective view of a cabinet system according to one embodiment.

Door closure assemblies are used to facilitate opening and closing doors. Applicant has recognized that by providing a door closure assembly that moves the door away from the cabinet such that the cabinet door does not contact the cabinet frame while the door is being opened, advantages may be realized. For example, when opening, the door may be moved outwardly and to the side of the front face of the cabinet. In some embodiments, the door may be moved in front of another, adjacent cabinet door. In some embodiments, such door closure assemblies may provide a user with improved access to the interior of the cabinet. The door closure assemblies also may allow for more efficient use of the cabinet. For example, the door closure assembly may be attached to a top and bottom of the cabinet, instead of along a side of the cabinet, resulting in the shelves being less obstructed or not obstructed by the door closure assembly.

Embodiments disclosed herein include a door closure assembly having first and second arms that connect a door to a cabinet. In some embodiments, a first end of each arm is pivotably attached to the cabinet, while a second end of each arm is pivotably attached to a door. For example, each arm may be connected to the cabinet and to the door via respective hinges. In some embodiments, the second ends of the arms may be attached at an end region of the door. For purposes herein, the end region of the door means a portion of the door within the last 25% of a length of the door. In some embodiments, the first end of the arm may be attached to a central region of the cabinet. For purposes herein, the central region of the cabinet includes a portion midway between the first and second sides of the cabinet (e.g., a midpoint along a length of the cabinet). The central region also includes a portion of the cabinet that is between 25% of the length of the cabinet to the left or to the right of the midpoint.

In some embodiments, each of the first and second arms are attached to the top (or bottom) of the cabinet. For example, a first end of each arm may be pivotally attached to the top of the cabinet, while the second end of each arm is pivotally attached to the top of the door. In such embodiments, a first end of the first arm is positioned next to the first end of the second arm, and the second end of the first arm is positioned next to the second end of the second arm. For example, the first end of the first arm may be positioned adjacent to the first end of the second arm, and the second end of the first arm may be positioned adjacent to the second end of the second arm. In these embodiments, the respective ends of each arm may be located directly next to one another. The respective ends of each arm also may be spaced from one another. For example, the first end of the first arm may be spaced between about 2 inches and 4 inches apart. As will be appreciated, in such embodiment, the first ends of each arm are still positioned in the central region of the cabinet, even though the first end of the first arm is spaced from the first end of the second arm.

In some embodiments, the door closure assembly includes a cabinet attachment member and a door attachment member, each of the arms being attached the attachment members. The cabinet attachment member may be attached to the cabinet frame and the door attachment member may be attached to the door.

In some embodiments, the first and second arms remain substantially parallel to one another while travelling between the open and closed positions. During the travel, a distance between the first and second arms may vary as the door is moved between the open and closed positions. For example, the arms may be positioned closer to one another when the door is in the closed position than when the door is in an intermediate position or in the open position.

In some embodiments, the door closure assembly allows the door to remain substantially parallel to a plane of a front face of the cabinet when the door is moved between the open and closed positions. As will be appreciated, in other embodiments, the door also may movable between the open and closed positions with the door positioned at an angle relative to the front of the cabinet.

In some embodiments, the door may be connected to the cabinet via more than one door closure assembly. For example, a first door closure assembly may connect the top of the door to the top of the cabinet and a second door closure assembly may connect the bottom of the door to bottom of the cabinet. In such an example, two arms may be used to attach the top of the door to the top of the cabinet, and two arms may be used to connect the bottom of the door to the bottom of the cabinet. In some embodiments, a connecting member, such as a connecting rod, is used to connect the first and second door closure assemblies to one another. For example, the connecting rod may be attached to one of the arms of the top door closure assembly and one of the arms of the bottom door closure assembly. In some embodiments, the connecting rod may allow the movement of the top door closure assembly to match the movement of the bottom door closure assembly. In some embodiments, the door may include one or more cutouts into which the arms and/or the connecting rod, or at least a portion of the arms and/or the connecting rod, may be received when the door is in a closed position.

In some embodiments, the door closure assembly may include one or more stoppers arranged to limit travel of the door. For example, the stoppers may prevent the door from opening too far and hitting an adjacent door. In such embodiments, to limit travel of the door, the stoppers are arranged to stop the door when the arms reach a prescribed distance from one another when the door is being opened.

Figure 2:
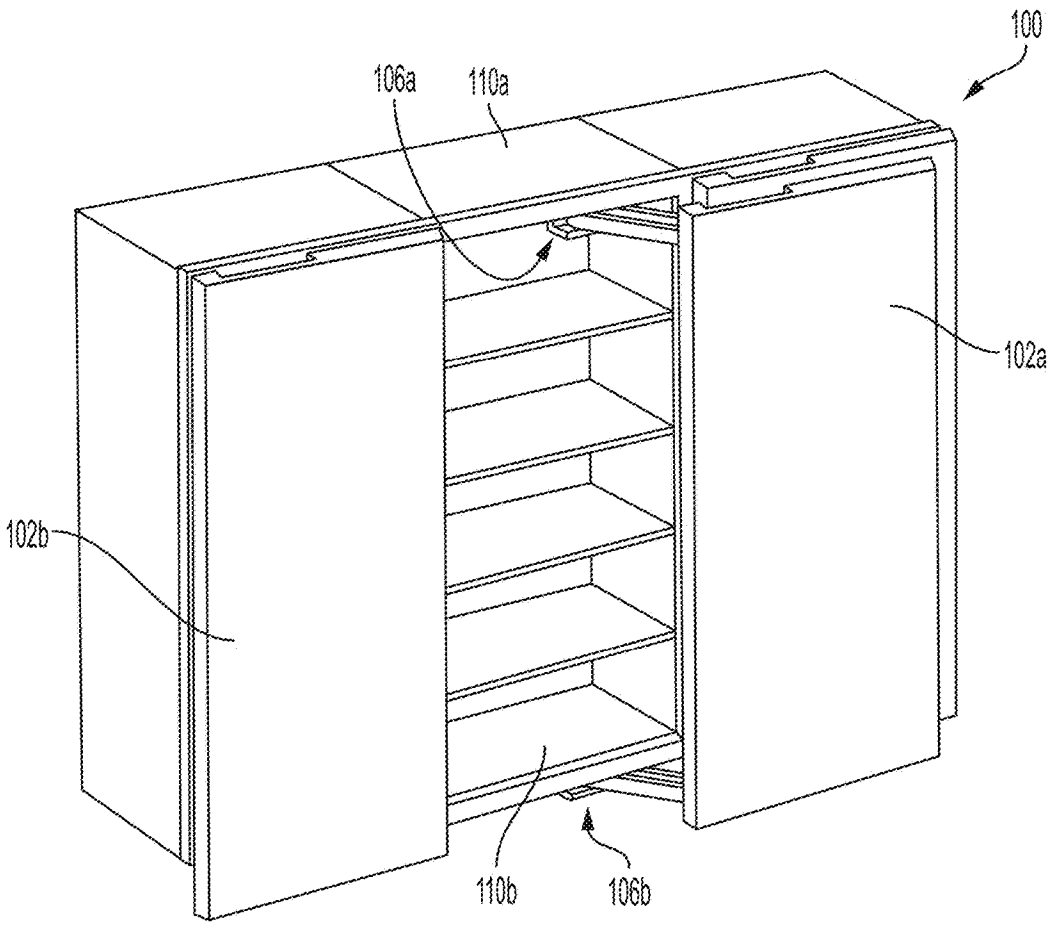
FIG. 2 shows the cabinet system of FIG. 1, with a door in an opened position.

Turning now to the figures, FIGS. 1 and 2 show an example of a cabinet system that uses a door closure assembly of the present disclosure. As shown in these views, the cabinet system 100 includes one or more doors 102*a*, 102*b*, 102*c* that are attached to respective cabinets 104*a*, 104*b*, 104*c*. In some embodiments, the doors and respective cabinets may extend substantially between a floor and ceiling, such as in a closet. As will be appreciated, the door closure assemblies may be used in shorter cabinet systems, such as with cabinets that extend only above or below (or only partly above or below) a countertop. As will be further appreciated, the door closure assembly may be used with just single cabinet and respective door (see, e.g., FIG. 3). The door closure assembly also may be used to attach a door to another fixture, such as to a door frame.

In some embodiments, as shown in FIG. 1, the doors may be substantially flush and parallel with one another when the doors are closed. The doors also may be substantially parallel to the respective cabinets when in the closed position.

In some embodiments, when the door is in the closed position, the door is positioned against the cabinet. For example, the inside of the door may be positioned against the front face 108 of the cabinet (see FIG. 3). In this position, the door may seal the cabinet, for example by including a gasket around the door's periphery. In some embodiments, as shown in FIG. 4, the doors may be spaced from the front face of the cabinet in the closed position. For example, the door may be positioned between 0.5 inches and about three inches from the front face of the door. In one such embodiment, the door may be positioned about 1 inch from the front face of the cabinet. In such an embodiment, the cabinet may accommodate articles that are slightly deeper than the cabinet. As will be appreciated, in traditional cabinet systems, the cabinet door would remain ajar if one or more items do not fit within the depth of the cabinet.

In some embodiments, as shown in FIGS. 4 and 5, the side edges of the door may be angled (see angle $\alpha$) with respect to a longitudinal axis of the door. For example, the sides of the door may angled between about 0 degrees and about 45 degrees, or between about 0 degrees and about 20 degrees, or between about 0 degrees and 10 degrees, or between about 5 degrees and 10 degrees. In some embodiments, the cross-sectional shape of the door from a top plan view is a parallelogram. As will be appreciated, the door also may be arranged at other suitable angles. In some embodiments, the angle of a first side edge of a first door 102*a* corresponds to the angle of a second, adjacent side edge of a second door 102*b*.

Figure 5A:
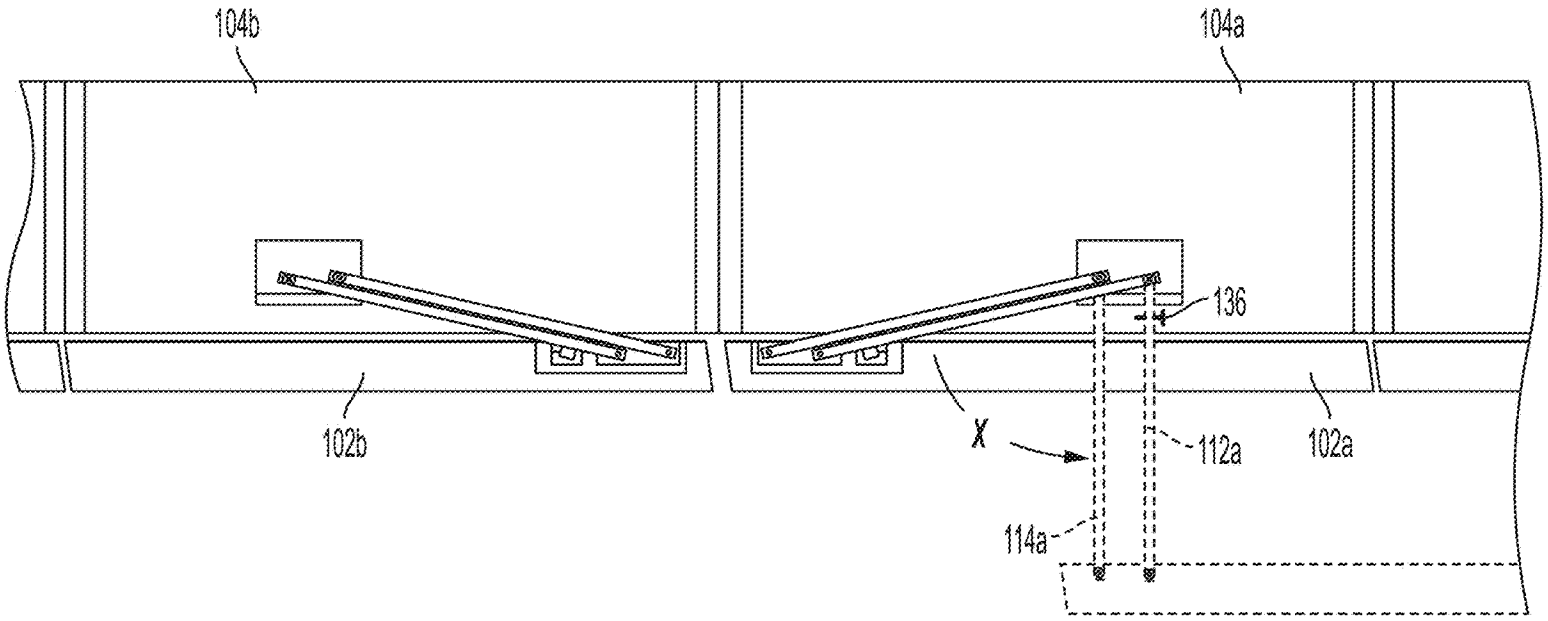
FIGS. 5A and 5B illustrate movement of a cabinet door according to one embodiment.

By angling the sides of the doors, the doors may move between the open and closed positions without hitting an adjacent door. In such embodiments, the doors also may be positioned closer to one another in the cabinet system such that the space between the doors (e.g., the seams between the doors) are smaller. As shown in FIG. 5A, a first side of a first door 102*a* may be spaced from a second side of a second door 102*b* by between about 1 inch and about 3 inches from one another. For example, the doors may be spaced about 2 inches from one another. As will be appreciated, in embodiments in which the sides of the doors are not angled (e.g., a rectangular cross-sectional shape), the doors may be spaced farther from one another (e.g., as compared to doors with angled sides) to allow the doors to move between the open and closed positions without hitting one another.

Turning back to FIG. 2, a perspective view of the closet system is shown with one of the doors 102*a* in an open position. As illustrated in this view, the door 102*a* may be attached to a respective cabinet 104*a* via first and second door closure assemblies 106*a*, 106*b*. In this embodiment, the first door closure assembly 106*a* attaches the top of the door to the top of the cabinet 104*a*, and the second door closure assembly 106*b* attaches the bottom of the door 102*a* to the bottom of the respective cabinet 104*a*. Although two door closure assemblies are used to attach the door to the cabinet in this embodiment, the door may be attached to the cabinet via only one door closure assembly in other embodiments. The door also may be attached to the cabinet via more than two door closure assemblies. For example, the door may be attached to the respective cabinet via first, second and third door closure assemblies in some embodiments.

As will be appreciated, more or fewer door closure assemblies may be used to accommodate heavier or lighter doors and/or to provide improved movement of the doors between the open and closed position. For example, a door connected to a cabinet via more than one door closure assembly may move with more control between the open and closed positions than a door connected to a cabinet via only one door closure assembly.

Figure 3:
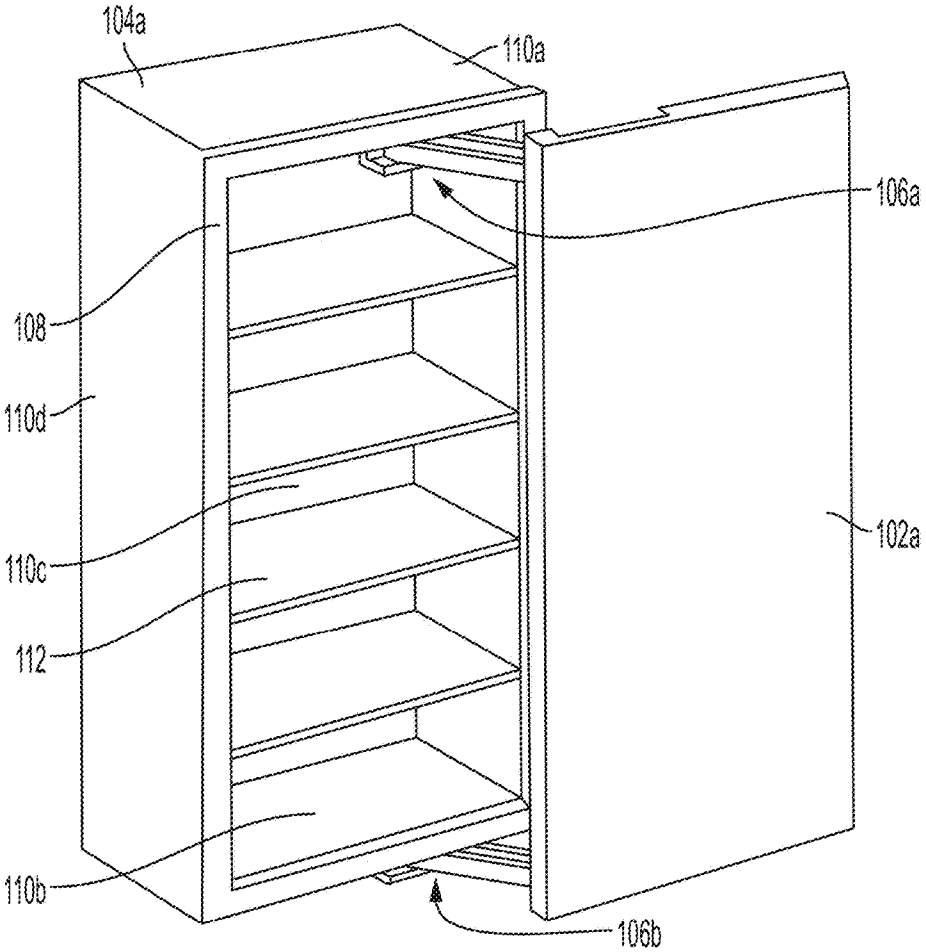
FIG. 3 is a perspective view of a cabinet according to one embodiment.
Figure 4:
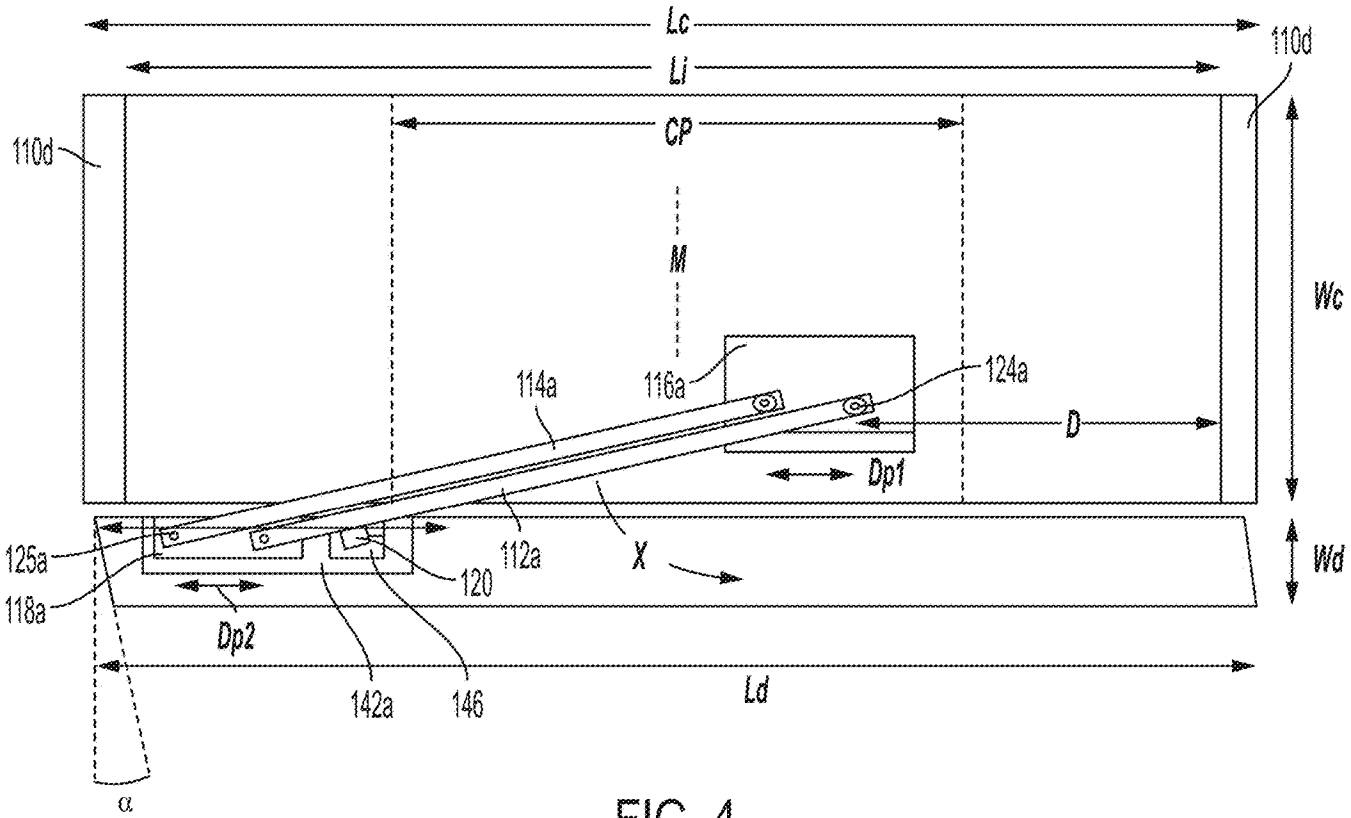
FIG. 4 is a top view of a cabinet, with a top panel of the cabinet and a top portion of a cabinet attachment member removed from view.

As illustrated in FIG. 3, in some embodiments, the cabinet 104*a* includes a frame with a front face 108, and top panel 110*a*, a bottom panel 110*b*, a rear panel 110*c*, and side panels 110*d*. The cabinet 104 also includes one or more shelves 112 which may be used to hold items such as dishes and plates. As will be appreciated, the shelves may be adjustable in some embodiments. In some embodiments, the inside of the cabinet may include one or more decorative panels which are attached to the insides of panels 110*a*, 110*b*, 110*c*, 110*d*.

In some embodiments, as shown in FIGS. 2 and 3, the first door closure assembly 106*a* may be attached to the top panel 110*a* of the cabinet 104*a*. For example, as shown in these views, the first door closure assembly 106*a* may be attached to an interior side of the top panel 110*a* of the frame 108. In such embodiments, the first door closure assembly 106 also may be attached to a top portion of the respective door. For example, the door closure assembly may be attached to a top of an interior side of the door. In some embodiments, as also shown in FIGS. 2 and 3, the second door closure assembly 106*b* may be attached to the bottom panel 110*b* of the frame, such as to an exterior side of the bottom panel 110*b*. In such embodiments, the second door closure assembly 110*b* may be attached to the bottom portion of the door, such as to a bottom of the interior side of the door.

Although the door closure assemblies are shown as being attached to the top and bottom of the cabinet frame (and to the top and bottom of the corresponding door), in other embodiments, the door closure assemblies may be attached to other suitable portions of the cabinet and door. For example, a door closure assembly may be attached to a shelf located in the middle of the cabinet and to a middle portion of the door. The door closure assemblies also may be attached to different portions of the top and bottom panels. For example, the top door closure assembly may be attached to an exterior surface of the top panel of the cabinet frame.

Figure 6:
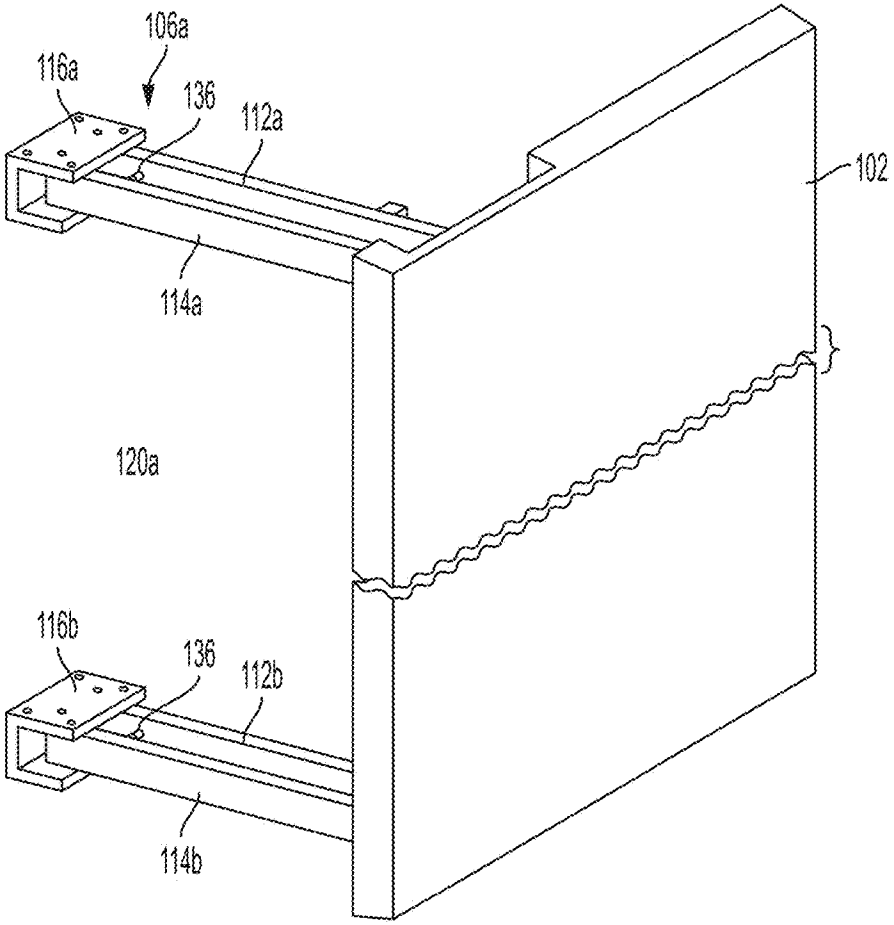
FIG. 6 is a front perspective view of a door closure assembly according to one embodiment.
Figure 7:
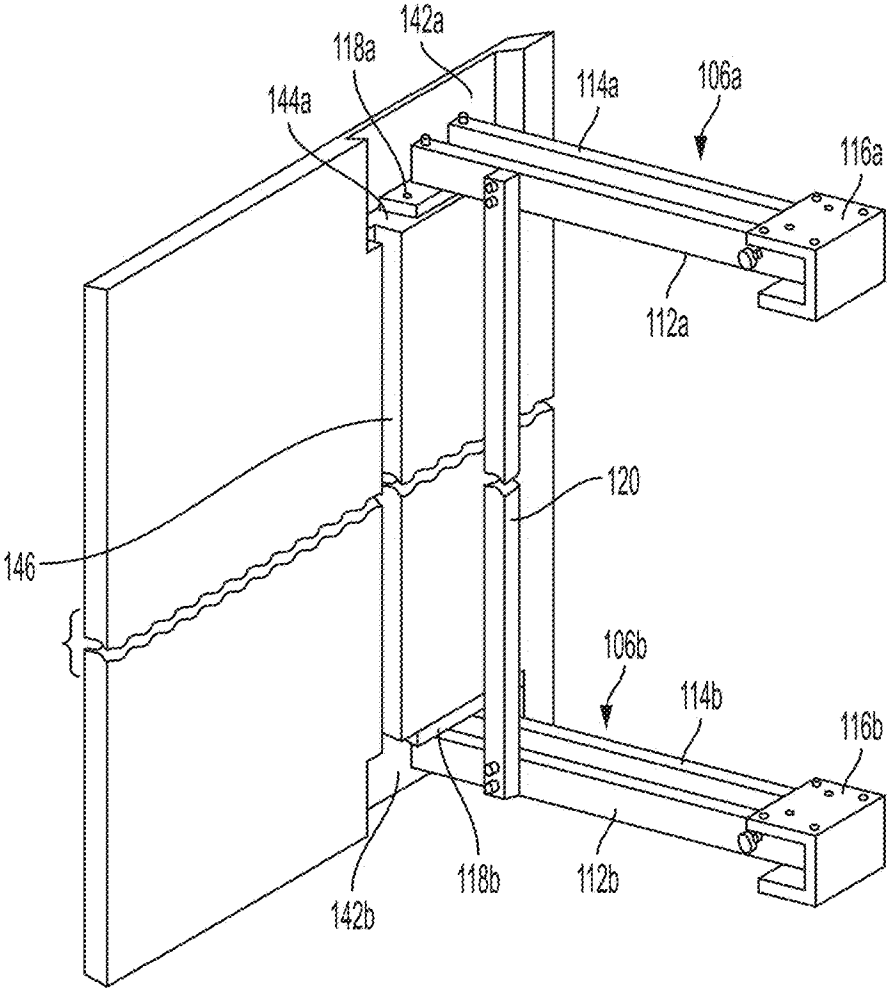
FIG. 7 is a rear perspective view of the door closure assembly of FIG. 6.

FIGS. 6 and 7 show the door closure assemblies 106*a*, 106*b* according to embodiments of the present disclosure with the cabinet removed from view. As shown in these views, the door closure assemblies includes first arms 112*a*, 112*b* and second arms 114*a*, 114*b*. Each arm is attached to the cabinet (not shown) via respective first and second cabinet attachment members 116*a*, 116*b*. Each arm is also attached to the door via respective first and second door attachment members 118*a*, 118*b*. In some embodiments, each arm is hingedly connected to the respective cabinet attachment member and door attachment member. For example, as shown in these views, a first end of each arm is hingedly connected to the cabinet attachment member and a second end of each arm is hingedly connected to the door attachment member. In such embodiments, the first end of each arm is pivotable relative to the cabinet attachment member (via the hinged connection) and the second end of each arm is pivotable relative to the door attachment member (via the hinged connection).

Although the arms are shown as being attached to the door and to the cabinet via respective attachment members, the arms may be attached directly to the door and to the cabinet member, for example via the first and second ends of each arm. In some embodiments each of the first and second arms may be hingedly connected to the cabinet and door. In such embodiments, the first and second arms may be pivotable relative to the cabinet and door via the hinged connections.

As also shown in FIGS. 6 and 7, a connecting member, such as a connecting rod 120, may connect the first and second door closure assemblies 106*a*, 106*b* to one another. In one embodiment, as shown in these views, the connecting rod 120 may be attached to the first arm 112*a* of the first door closure assembly 106*a* and the first arm 112*b* of the second door closure assembly 106*b*. Although the connecting rod is shown as being attached to the first arms, the connecting rod also may be attached to the second arms in other embodiments. Additionally, although the connecting rod is shown as being attached to the arms in a position close to the door attachment members and the door, the connecting rod may be attached at other suitable locations. In some embodiments, the connecting rod may be attached to the arms via fasteners, such as screws that threadably engage with the first and second arms.

Figure 10:
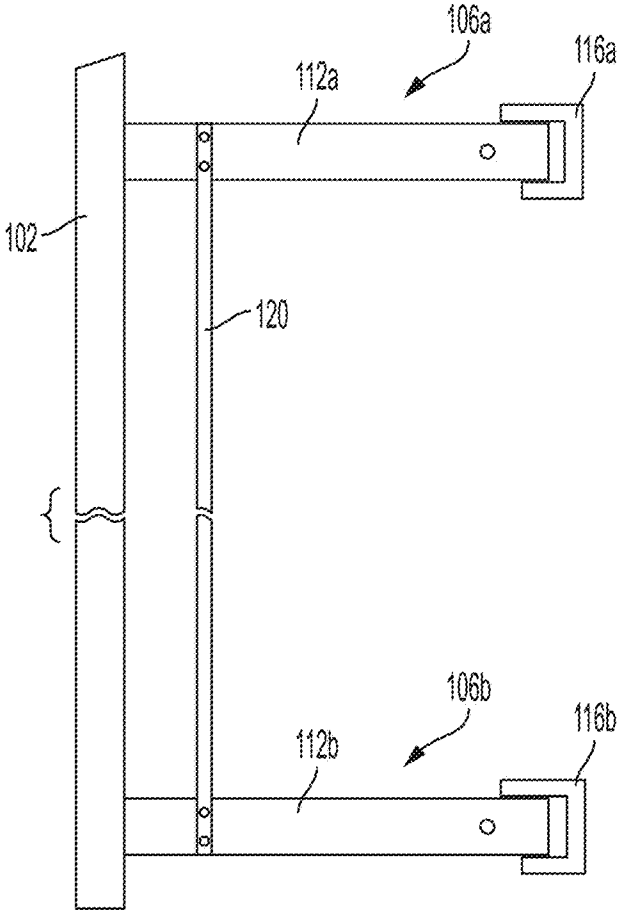
FIG. 10 is a side view of the door closure assembly of FIG. 6.

In some embodiments, as shown in FIG. 10, the connecting rod 120 may extend substantially perpendicularly to each of the first and second door closure assemblies (and the corresponding cabinet and door attachment members). The connecting rod 120 also may extend substantially parallel to the corresponding door 102.

Figure 8:
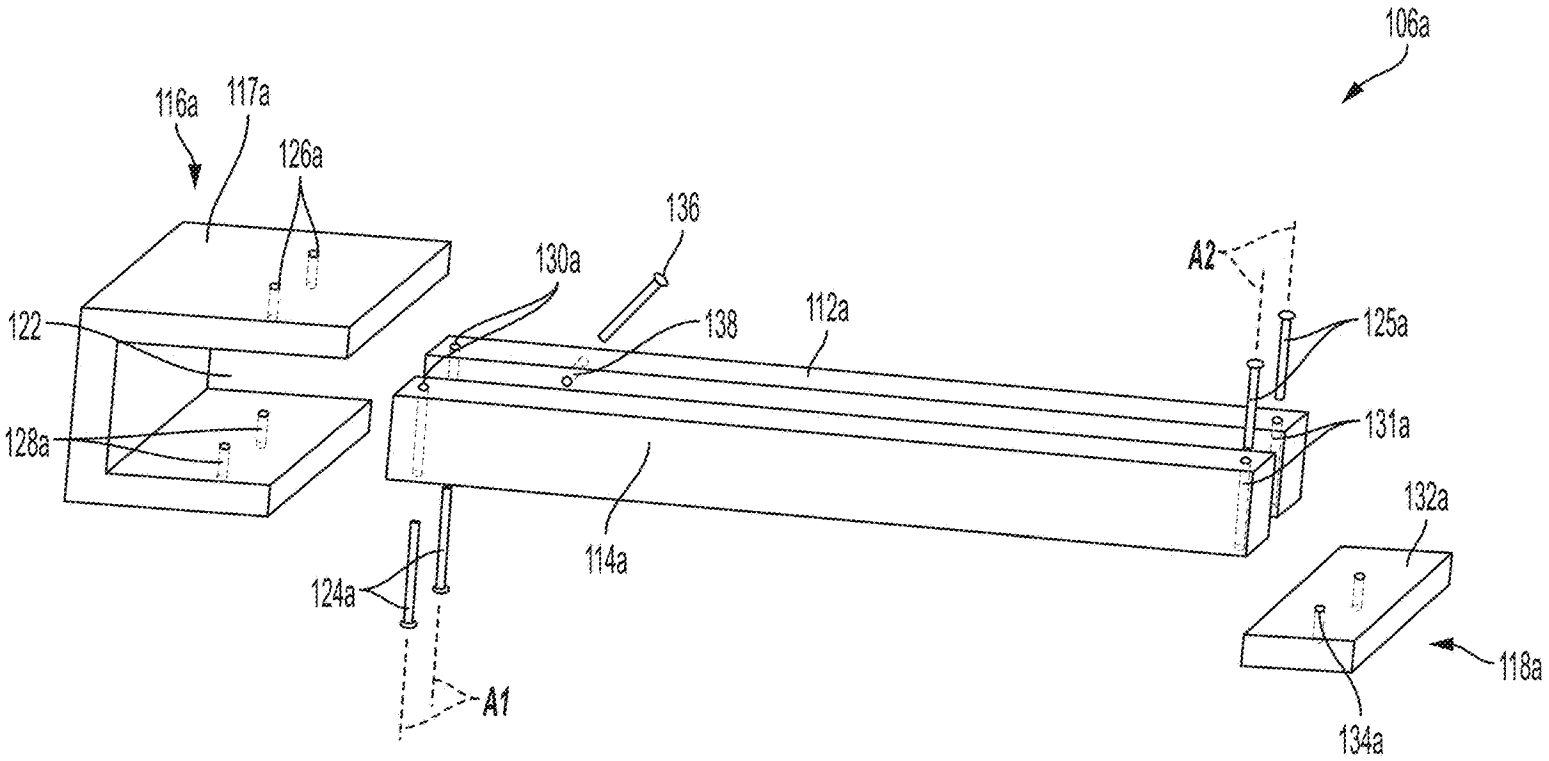
FIG. 8 is an exploded view of a door closure assembly according to one embodiment.

FIG. 8 shows an exploded perspective view of the first door closure assembly 106*a* according to some embodiments. As shown in this view, the first and second arms 112*a*, 114*a* may include straight rods having a rectangular cross-section. For example, in some embodiments, the rods may be between about 0.5 and 1 inch wide, such as about 0.75 inches wide, and may be between about 1.25 and 3 inches tall, such as about 2 inches tall. As will be appreciated, the rods also may have other suitable shapes in other embodiments. For example, the rods may have a circular, oval, triangular, hexagonal, pentagonal, other polygonal or other cross-sectional shape. In other embodiments, the rods may be curved between first and second ends.

Figure 9:
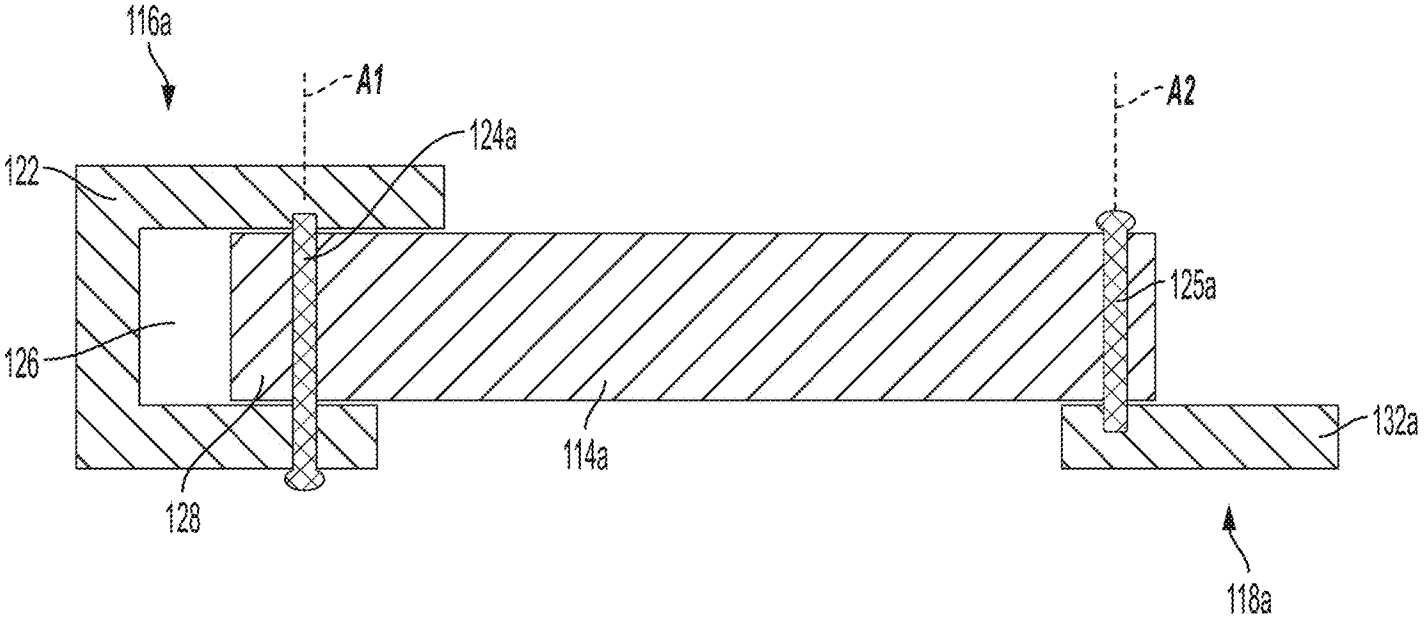
FIG. 9 is a cross-sectional schematic view of the door closure assembly of FIG. 8.

In some embodiment, as shown in FIGS. 8 and 9, the first cabinet attachment member 116*a* may include a C-shaped bracket 117*a* with an opening 122 that receives a first end of the first and second arms 112*a*, 114*a*. As shown in these views, the arms 112*a*, 114*a* may be attached to the bracket 117*a* via fasteners 124. For example, when the arms are inserted into the opening 122 in the bracket 116*a*, respective openings in the bracket above and below each arm 126*a*, 128*a* may be aligned with channels 130*a* extending through the arms 112*a*, 114*a*. As will be appreciated, the channels 130*a* may be located near the first end of each arms.

As shown in FIG. 9, the openings below the arms may include a channel extending through the bottom portion of the bracket 117*a*. During assembly, the fasteners 124*a* may be inserted into the opening 128*a* below the arm, passed through the channel 130*a* in the arm, and secured to the top of the bracket via the opening 126*a* located above the arm. In one example, the fasteners may include screws that threadably engage with the openings 126*a* in the top of the bracket. Although not shown, in some embodiments, a washer may be placed between a head of the fastener and an exterior side of the bottom of the bracket.

Although fasteners are shown in FIGS. 8 and 9 for attaching the arms to the bracket 117, the arms may be attached to the bracket via other suitable arrangements. For example, in some embodiments, a spring-loaded pin may be used to attach the arms to the bracket. In such an example, the pin may be biased toward an open position, such that the pin may be compressed within the channel in the arm when the arm is inserted into the opening 122 of the bracket. Once the channel in the arm is aligned with the openings in the bracket, the pin may spring into an open position to secure the arm to the bracket.

As will be further appreciated, although the door attachment members are shown as being C-shaped brackets, other suitable attachment members may be used. For example, the attachment member may include a plate, such as a plate similar to the plate used to attach the arms to the door, as described below. Other arrangements also may be used. For example, the first end of the arm may be attached directly to the cabinet via a fastener.

In some embodiments, as shown in FIGS. 8 and 9, the first door attachment member 118*a* includes a plate 132*a* to which the second end of the arms 112*a*, 114*a* are attachable. As shown in these views, the plate 132*a* includes openings 134*a* which may be positioned below and aligned with channels 131*a* extending through the arms 112*a*, 114*a*. In some embodiments, the channels 131*a* are located at or near a second end of each arm. Once aligned, fasteners 125*a* may be inserted into the channels and engaged with the openings in the plate. For example, the fasteners may include screws that are threadably engaged with the openings 134*a* in the plate 132*a*.

The shape and size of the channels in the arms correspond to the shape and size of the fasteners. For example, as shown in these views, the arms include cylindrical-shaped openings that correspond to the cylindrical-shaped fasteners. In such embodiments, the length of the channel may be shorter than a length of the fastener so that the fastener may extend through the channel to engage with one of the attachment members. In a similar fashion, the shape of the openings in the attachment members correspond to the shape of the fasteners. For example, in embodiments in which the fasteners are screws, the openings may include threads that correspond to the threads on the screws.

As shown in FIG. 9, when the arms are attached to the cabinet and door attachment members, the arms extend substantially parallel to the attachment members. In such embodiments, the fasteners may extend substantially perpendicularly to the longitudinal axis of the arms.

As shown in FIGS. 8 and 9, each arm is pivotally attached to the cabinet attachment member and to the cabinet (not shown) on one side, and is pivotally attached to the door attachment member and to the door on another side. In such embodiments, each arm has two pivot axes. For example, a first end of each arm may pivot about a first pivot axis A1 at the cabinet attachment member and may pivot about a second pivot axis A2 at the door attachment member. As shown in FIGS. 8 and 9, the first pivot axis A1 may be defined by the fastener 124*a* extending through the channel near the first end of the arm 112*a*, 114*a*. As will be appreciated, such a first pivot axis A1 may extend substantially perpendicularly to a longitudinal axis of the arm. As also shown in FIGS. 8 and 9, the second pivot axis A2 may be defined by the fastener 125*a* extending through the respective channels near the second ends of the rod 112*a*, 114*a*. As will be appreciated, the second pivot axis A2, also extends substantially perpendicularly to the longitudinal axis of the arm.

For purposes herein, pivoting of the first and second arms about an axis means that the arm pivots, rotates, turns, swivels, or otherwise moves in other than a purely translational movement. In such embodiments, rotation of the each arm about the respective pivot axes allows the door to be moved between the open and closed positions.

In some embodiments, the first pivot axis A1 of the first arm 112*a* is defined where the first arm attaches to the cabinet attachment member 116*a*, and the first pivot axis A1 of the second arm 114*a* is defined where the second arm attaches to the cabinet attachment member 116*a*. In a similar fashion, the second pivot axis A2 of the first arm 112*a* is defined where the first arm attaches to the door attachment member 118*a*, and the second pivot axis A2 of the second arm 114*a* is defined where the second arm 114*a* attaches to the door attachment member 118*a*.

As shown in FIG. 8, the first pivot axis A1 of the first arm 112*a* is parallel to and spaced from the first pivot axis A1 of the second arm 114*a*. In a similar fashion, the second pivot axis A2 of the first arm 112*a* is parallel to and spaced from the second pivot axis A2 of the second arm 114*a*. In some embodiments, as shown in FIG. 4, a distance Dp1 between the first pivot axes A1 (e.g., a distance between fasteners 124*a* extending through the channels at the first end of the arms) is between about 2 inches and about 4 inches. For example, in one embodiment, the distance between the first pivot axes may be about 3.25 inches. In some embodiments, the distance Dp1 between the first pivot axes A1 is the same as the distance Dp2 between the second pivot axes A2, as shown in FIG. 4. As will be appreciated, the distance between the second pivot axes Dp2 is the distance between the fasteners 125*a* extending through the channels near the second end of each arm. In other embodiments, the distance between the first pivot axes Dp1 is different from the distance between the second pivot axes Dp2.

As also shown in FIG. 4, where top views of the cabinet system are shown with the top panel of the cabinet frame and a top of the bracket 117*a* being removed from view, the cabinet includes a length Lc and a width Wc. In such embodiments, the length of each cabinet Lc includes the length Li of the interior of the cabinet plus a length of each side panel 110*d*. The door also includes a length Ld and a width Wd. As will be appreciated, in embodiments in which the door does not have a rectangular cross section, such as those shown in FIGS. 4 and 5A-5B, the length Ld of the door includes a distance between a plane extending through an outermost point on a first side of the door and a plane extending through an outermost point on a second, opposite side of the door. In some embodiments, the length of the door Ld may be the same as the length of the cabinet Lc. The length of the door Ld also may be shorter than the length of the cabinet Lc. In such an embodiment, the length of the door Ld may still be greater than the length of the interior Li of the cabinet.

In some embodiments, the length Lc of the cabinet may be between about 33 and 36 inches, with the length Li of the interior of the cabinet being between about 29 inches and about 34 inches. In some embodiments, the width of the cabinet is between about 10 inches and about 16 inches. In some embodiments, the length Ld of the door is between about 30 inches and about 35 inches. In some embodiments, the width Wd of the door is between about 1.5 inches and about 2 inches.

As shown in FIG. 4, in some embodiments, the cabinet attachment member is attached in a central portion CP of the cabinet. For purposes herein, the central portion of the cabinet includes locations midway between the side panels 110*c* of the cabinet frame (see midline M). For example, in embodiments in which the interior length of the cabinet is about 31 inches, the cabinet attachment member may be attached to and aligned with the cabinet member at a location about 15.5 inches from one of the side panels. For purposes herein, being aligned with the midline M means that the cabinet attachment member is centered along the length of the cabinet. The central portion of the cabinet also includes any position along the length of the cabinet that is to the left or right of the midline M by a distance of about 25% of a length of the cabinet. In one example, as shown in FIG. 4, a distance D from the side of the cabinet to the first pivot axis of the first arm (at fastener 124*a*) is about 9.5 inches. In such embodiments, as shown in this view, the first pivot axis of the second arm is further away from the opposite side of the cabinet such that the first attachment member 116*a* is located to the right of the midline M.

In some embodiments, the cabinet attachment member is positioned near the front of the cabinet. In some embodiment, the cabinet attachment member may be positioned in the front half of the cabinet. In some embodiments, the cabinet attachment member may positioned at the front edge of the cabinet.

In some embodiments, the door attachment member may be positioned near an end of the door. For purposes herein, the end portion of the door may include a position that is within a last third of a length of the door. For example, the end portion may include a position that is within a last 25% of the length of the door. In some embodiments, as shown in FIG. 4, the first door attachment member 118*a* may be positioned between about 1 inch and 6 inches from the from a side of the door. As will be appreciated, the first door attachment member may be positioned in any suitable location in the last third of a length Ld of the door. For example, in one example, a distance D2 to the first pivot point of the door attachment member (at fastener 125*a*) may be about 4 inches.

As shown in FIG. 4, in embodiments in which the cabinet attachment member is positioned in a central portion of the cabinet, on a first side of the midline of the cabinet (e.g., on the right side), the door attachment member may be positioned in the last third of the length of the door on a second, opposite side of the midline of the cabinet (e.g., on the left side of the door). In such embodiments, this arrangement allows the rods to be moved from left to right (see arrow X), driving movement of the door to the open position. In other embodiments, as shown in FIG. 4, the door attachment member may be positioned in the last third of the length of the door on the right side, while the cabinet attachment member is located in the central portion of the cabinet, to the left of the midline. In such embodiments, the rods may move from right to left to move the door between the closed and open positions.

Figure 5B:
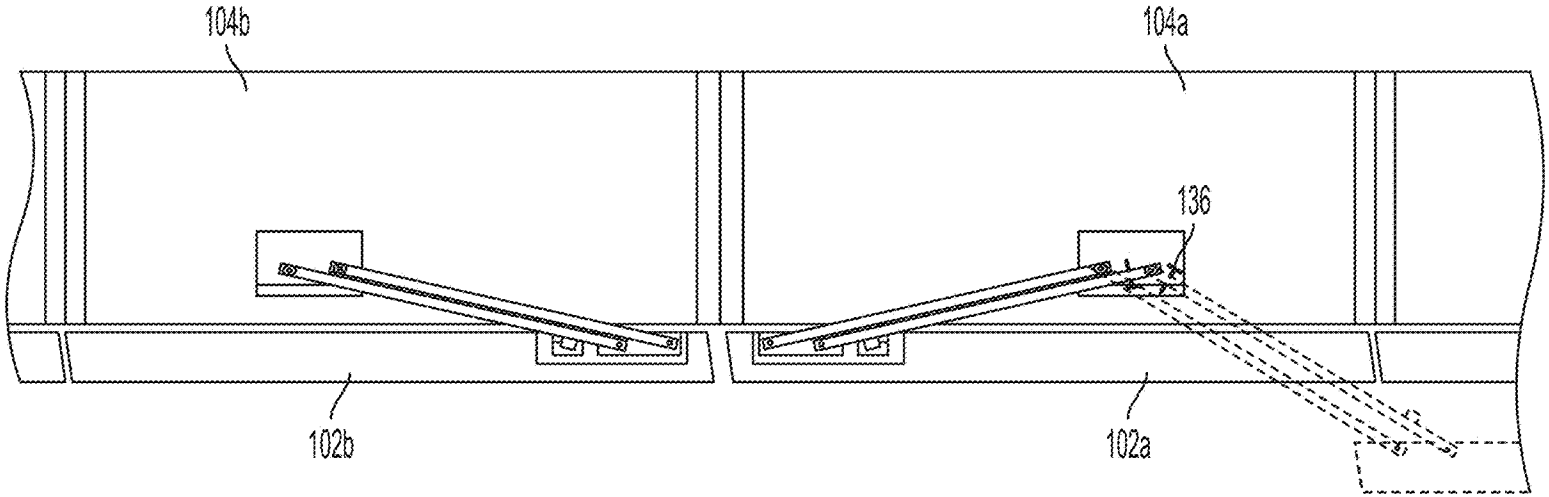

In some embodiments, as shown in FIGS. 1 and 2, the position of the cabinet and door attachment members may be the same from cabinet to cabinet. In such embodiments, all of the doors may be arranged to move in the same direction, such as from left to right. In other embodiments, as shown in FIGS. 5A-5B, the positions of the cabinet and door attachment members may be varied such that the doors move in different directions. For example, as shown in this view, the first cabinet door 102*a* may move from left to right, while the second cabinet door 102*b* may move from right to left.

FIGS. 5A and 5B illustrate movement of one of the doors 102*a* between a closed position and an open position, with the open door being shown in phantom lines. As shown in these views, as the arms are moved in direction X, the door is moved outwardly and away from the front of the cabinet. The door moves in an arc-like manner between the open and closed position.

As shown in FIGS. 5A-5B, during movement of the door, the door 102*a* may remain substantially parallel to the cabinet. As will be appreciated, the door also may become angled relative to the cabinet during travel. As also shown in FIGS. 5A and 5B, a distance between the door and the cabinet (e.g., the front panel of the cabinet) changes as the door is moved between the open and closed position. As shown in FIG. 5A, in an intermediate position, the cabinet is located the farthest from the cabinet (e.g., the greatest distance from the cabinet) than in the open or closed position. As shown in FIGS. 5A and 5B, the door is positioned closer to the cabinet in the closed position than in the opened position.

As also shown in these views, as the door is moved between the open and closed positions, a distance between the arms changes. For example, in the closed and open positions, the arms are closer together than are when the door is in the intermediate position (see FIG. 5A). The arms also may be positioned closer together in the closed position than in the open position.

In some embodiments, as shown in FIGS. 5A-5B and 12A-12B, one of the door closure assemblies may include a stopper 136 arranged to limit travel of the door between the open and closed position. The stopper may prevent the door from opening too far in one direction so that the door does not hit an adjacent door. In some embodiments, as shown in FIG. 5A, the stopper may extend at least partially between the first arm 112*a* and the second arm 114*a*. In some embodiments, the stopper may include an adjustable screw that is inserted into a channel 138 in the arm (see FIG. 8).

Figure 12B:
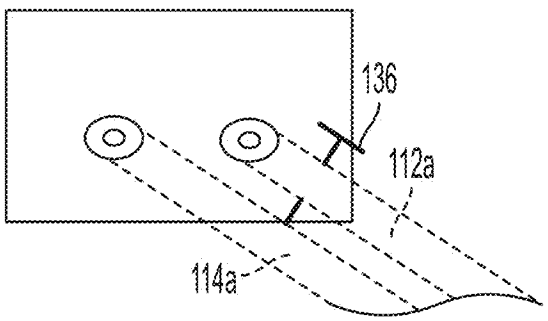
FIGS. 12A and 12B are enlarged fragmentary views of door closure assemblies in closed and open positions, respectively.
Figure 12A:
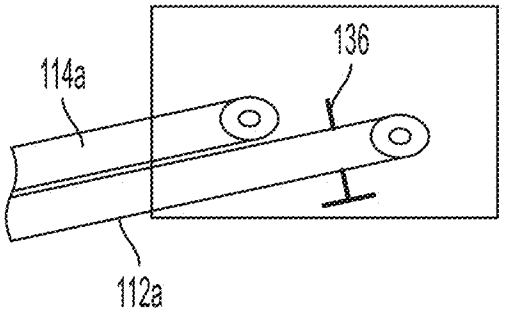

In use, as shown in FIGS. 5B and 12B, when the door reaches the open position and the arms are a prescribed distance apart, the second arm 114*a* hits the stopper 136. Such contact stops the second arm 114*a* from being moved closer to the first arm 112*a*, which stops the door from moving further, such as towards an adjacent door. In the closed position, as shown in FIG. 12A, the stopper is moveable to a position in between the first and second bars. For example, the distal end of the stopper may extend in between the first ends of the first and second bars. In this position, the stopper 136 does not contact the second bar 114*a* such that the door may close.

Although the stopper is shown on the first door closure assembly in this figure, the stopper may be on just the second door closure assembly or on both door closure assemblies. In some embodiments, some cabinets in the cabinet system may include a stopper (e.g., cabinets that have adjacent doors that they could contact) while other cabinets in the system do not.

Although the stopper is shown as being a screw that extends partially between the first and second arms, other stoppers may be used. For example, the stopper may include a spring attached between the first and second arms, the spring extending and contracting as the door moves between the open and closed positions.

Figure 11:
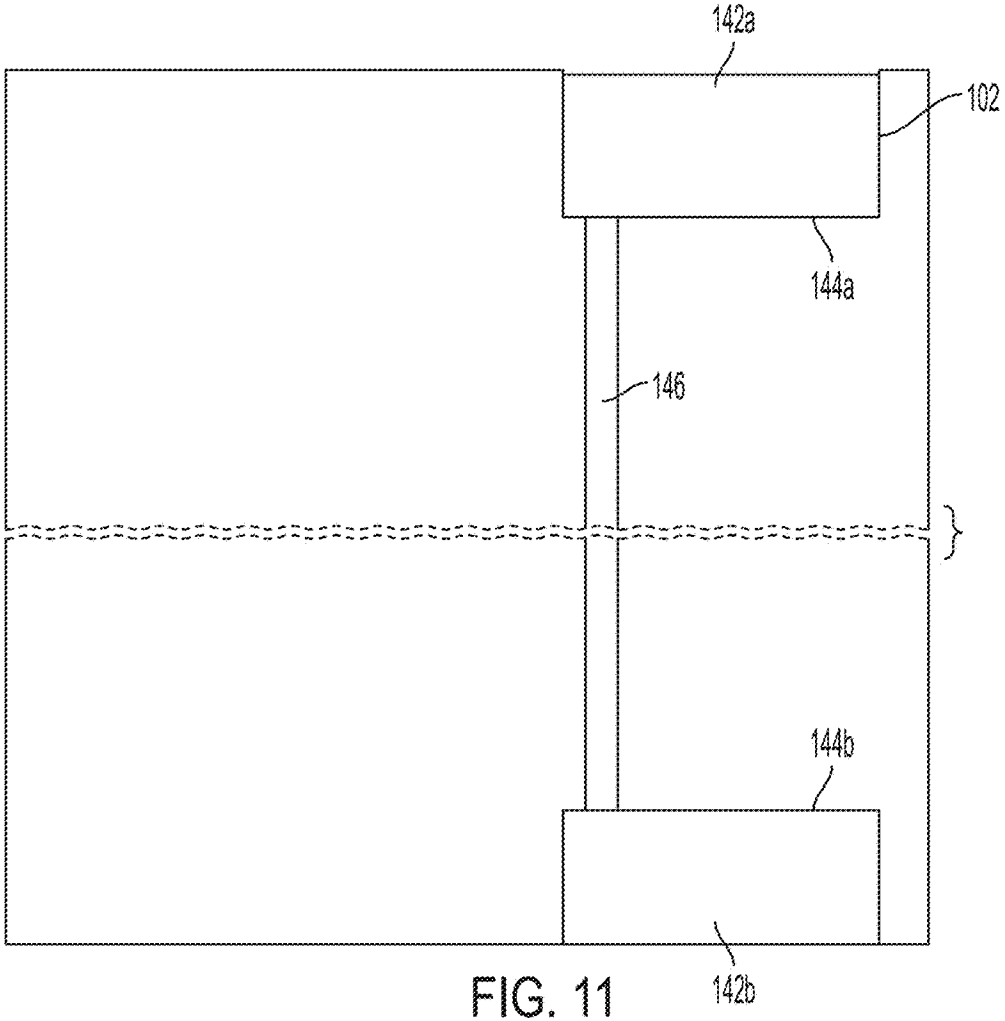
FIG. 11 is a rear view of a door according to one embodiment.

In some embodiments, as shown in FIGS. 7 and 11, the door 102 may include one or more cutouts for accommodating the door closure assemblies. For example, in some embodiments, as shown in these views, the door may include first and second cutouts 142*a*, 142*b* for attaching the first and second door closure assemblies. As shown in FIG. 7, in some embodiments, the first door attachment member 118*a* is attached to a ledge 144*a* formed on the door at the first cutout 142*a*. In a similar fashion, the second attachment member 118*b* can be attached to a corresponding ledge 144*b* in the second cutout 142*b*. As also shown in FIG. 4, when the door is in the closed position, at least a portion of the first and second arms 112*a*, 114*a* are received in the first cutout. In some embodiments, the cutout is substantially rectangular in cross section.

In some embodiments, such as those where the connecting rod 120 is used, the door also may include a third cutout 146 (see FIGS. 7 and 11) that extends vertically between the first and second cutouts 142*a*, 142*b*. As shown in FIG. 4, when the door is in the closed position, at least a portion of the rod is received in the third cutout 146. In some embodiments, the entire rod is received in the third cutout. The shape and size of the cutout may correspond to the shape and size of the connecting rod.

Although the door closure assembly has been described for use with a cabinet, the door closure assembly may be used to attach a door to any corresponding structure. For example, the door closure assemblies disclosed herein may be used with a closet door or with another type of door.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A door closure assembly comprising:

a first attachment member attachable to a top of a cabinet;

a second attachment member attachable to a top of a door;

a first arm having first and second ends, the first end of the first arm being pivotally connected to the first attachment member, and the second end of the first arm being pivotally connected to the second attachment member;

a second arm having first and second ends, the first end of the second arm being pivotally connected to the first attachment member, and the second end of the second arm being pivotally connected to the second attachment member, wherein the second arm is horizontally spaced from the first arm;

a third attachment member attachable to the bottom of the cabinet;

a fourth attachment member attachable to the bottom of the door;

a third arm having first and second ends, the first end of the third arm being pivotally connected to the third attachment member, and the second end of the third arm being pivotally connected to the fourth attachment member;

a fourth arm having first and second ends, the first end of the fourth arm being pivotally connected to the third attachment member, and the second end of the fourth arm being pivotally connected to the fourth attachment member, wherein the fourth arm is horizontally spaced from the third arm; and a connecting rod, wherein a first end of the connecting rod is attached to one of the first and second arms and the second end of the connecting rod is attached to one of the third and fourth arms.

2. The door closure assembly of claim 1, wherein the second arm is parallel to the first arm.

3. The door closure assembly of claim 2, wherein:

the first end of the first arm is connected to the first attachment member via a first hinge, the first hinge defining a first axis of rotation about which the first arm rotates relative to the first attachment member; and the second end of the first arm is connected to the second attachment member via a second hinge, the second hinge defining a second axis of rotation about which the first arm rotates relative to the second attachment member.

4. The door closure assembly of claim 3, wherein:

the first end of the second arm is connected to the first attachment member via a third hinge, the third hinge defining a third axis of rotation about which the second arm rotates relative to the first attachment member; and the second end of the second arm is connected to the second attachment member via a fourth hinge, the fourth hinge defining a fourth axis of rotation about which the second arm rotates relative to the second attachment member.

5. The door closure assembly of claim 4, wherein the first axis of rotation of the first arm is spaced from and parallel to the first axis of rotation of the second arm.

6. The door closure assembly of claim 5, wherein a distance between the first axis of rotation of the first arm and the first axis of rotation of the second arm is different from a distance between the second axis of rotation of the first arm and the second axis of rotation of the second arm.

7. The door closure assembly of claim 4, wherein the second axis of rotation of the first arm is spaced from and parallel to the second axis of rotation of the second arm.

8. The door closure assembly of claim 4, wherein a distance between the first axis of rotation of the first arm and the first axis of rotation of the second arm is the same as a distance between the second axis of rotation of the first arm and the second axis of rotation of the second arm.

9. The door closure assembly of claim 4, wherein:

the first end of the third arm is connected to the third attachment member via a fifth hinge, the fifth hinge defining a fifth axis of rotation about which the third arm rotates relative to the third attachment member;

the second end of the third arm is connected to the fourth attachment member via a sixth hinge, the sixth hinge defining a sixth axis of rotation about which the third arm rotates relative to the fourth attachment member;

the first end of the fourth arm is connected to the third attachment member via a seventh hinge, the seventh hinge defining a seventh axis of rotation about which the fourth arm rotates relative to the third attachment member; and the second end of the fourth arm is connected to the fourth attachment member via an eighth hinge, the eighth hinge defining an eighth axis of rotation about which the second arm rotates relative to the fourth attachment member.

10. The door closure assembly of claim 9, wherein the first axis of rotation is parallel to the second axis of rotation and to one of the third and fourth axes of rotation.

11. The door closure assembly of claim 2, wherein the third arm is parallel to the fourth arm.

12. The door closure assembly of claim 11, wherein the third and fourth arms remain parallel to one another as the door travels between the open and closed positions.

13. The door closure assembly of claim 2, wherein the first and second arms remain parallel to one another as the door travels between an open position and a closed position.

14. The door closure assembly of claim 13, wherein the first and second arms remain parallel to one another when the first and second arms rotate relative to the first and second attachment members.

15. The door closure assembly of claim 1, wherein each of the first and third attachment members includes a C-shaped bracket.

16. The door closure assembly of claim 1, wherein each of the second and fourth attachment members includes a plate.

17. The door closure assembly of claim 1, further comprising a stopper attached to one of the first and second arms, a distal end of the stopper extending toward the other of the first and second arms.

18. The door closure assembly of claim 17, wherein, when the door is in an open position, the distal end of the stopper contacts the other of the first and second arms to stop movement of the other of the first and second arms.

19. The door closure assembly of claim 1, wherein the connecting rod extends vertically between the one of the first and second arms and the one of the third and fourth arms.

20. The door closure assembly of claim 19, wherein the connecting rod is perpendicular to the one of the first and second arms and the one of the third and fourth arms.

21. The door closure assembly of claim 1, wherein the first end of the first arm is horizontally spaced between two inches and four inches from the first end of the second arm.

22. The door closure assembly of claim 21, wherein the second end of the first arm is horizontally spaced between two inches and four inches from the second end of the second arm.

* * * * *